US006617047B1

(12) United States Patent
Hüffer et al.

(10) Patent No.: US 6,617,047 B1
(45) **Date of Patent: *Sep. 9, 2003**

(54) METHOD FOR COATING APPARATUSES AND PARTS OF APPARATUSES USED IN CHEMICAL MANUFACTURING

(75) Inventors: Stephan Hüffer, Ludwigshafen (DE); Thilo Krebs, Mannheim (DE); Wolfgang Loth, Bad Dürkheim (DE); Bernd Rumpf, Hockenheim (DE); Jürgen Sturm, Harthausen (DE); Bernd Diebold, Fussgönheim (DE); Juergen Korkhaus, Wachenheim (DE); Joachim Nilges, Ludwigshafen (DE); Axel Franke, Carlsberg (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/869,139

(22) PCT Filed: Dec. 24, 1999

(86) PCT No.: PCT/EP99/10371

§ 371 (c)(1),
(2), (4) Date: Jun. 26, 2001

(87) PCT Pub. No.: WO00/40774

PCT Pub. Date: Jul. 13, 2000

(30) Foreign Application Priority Data

Dec. 30, 1998 (DE) ..... 198 60 526

(51) Int. Cl.[7] ..... B05D 1/36; B05D 1/18; B05D 7/22; B32B 15/04; B32B 15/00

(52) U.S. Cl. ..... 428/624; 428/680; 428/457; 427/436; 427/437; 427/438; 427/443.1; 427/404; 427/405; 427/419.1; 427/239

(58) Field of Search ..... 427/436, 437, 427/438, 443.1, 404, 405, 419.1, 239; 428/624, 680, 457

(56) References Cited

U.S. PATENT DOCUMENTS

| | | | | |
|---|---|---|---|---|
| 4,098,654 A | | 7/1978 | Helle et al. | |
| 4,472,290 A | * | 9/1984 | Caporiccio et al. | 508/181 |
| 4,483,711 A | * | 11/1984 | Harbulak et al. | 106/1.22 |
| 6,230,498 B1 | * | 5/2001 | Bin-Nun et al. | 62/6 |

FOREIGN PATENT DOCUMENTS

| | | | |
|---|---|---|---|
| CH | 633 586 | | 12/1982 |
| DE | 197 28629 | | 1/1999 |
| EP | 062 901 | | 10/1982 |
| EP | 575 872 | | 12/1993 |
| EP | 737759 A | * | 10/1996 |
| EP | 737 759 | | 10/1996 |
| JP | 63-293169 | | 11/1988 |
| SU | 1671740 | | 8/1992 |
| WO | 98/37457 | | 8/1998 |

OTHER PUBLICATIONS

Zhang et al., "Characterization of Electroless Ni–P–PTFE Composite Deposits", Chapman & Hall, 1998, pp. 119–122.*

Tulsi, "Electroless Nickel–PTFE Composite Coatings", Transactions Of The Institute Of Metal Finishing, vol. 61, 1983, pp. 147–149.*

XP–002142270;Chemisch–Nickel, Riedel, 842–844, 1990.

Electroless Nickel–PTFE Composite Coatings,Tulsi, 147–149, 1983.

Characterization of electroless Ni–P–PTFE composite deposits, Zhang et al., 119–122, 1998.

Chemical Reaction Fouling: A Review, Watkinson et al. Experimental Thermal and Fluid Sci., 1997, 371–374.

Riedel,Funktionelle Vernickelung, Verlag Eugen Leize, Saulgau, 1989, 231–236.

* cited by examiner

*Primary Examiner*—Michael Barr
(74) *Attorney, Agent, or Firm*—Keil & Weinkauf

(57) ABSTRACT

The present invention relates to a process for coating apparatuses and apparatus parts for chemical plant construction—which are taken to mean, for example, apparatus, tank and reactor walls, discharge devices, valves, pumps, filters, compressors, centrifuges, columns, dryers, comminution machines, internals, packing elements and mixing elements—wherein a metal layer or a metal/polymer dispersion layer is deposited in an electroless manner on the apparatus(es) or apparatus part(s) to be coated by bringing the parts into contact with a metal electrolyte solution which, in addition to the metal electrolyte, comprises a reducing agent and optionally the polymer or polymer mixture to be deposited in dispersed form, where at least one polymer is halogenated.

14 Claims, No Drawings

METHOD FOR COATING APPARATUSES AND PARTS OF APPARATUSES USED IN CHEMICAL MANUFACTURING

The present invention relates to a process for coating apparatuses and apparatus parts for chemical plant construction—which are taken to mean, for example, apparatus, tank and reactor walls, discharge devices, valves, pumps, filters, compressors, centrifuges, columns, dryers, comminution machines, internals, packing elements and mixing elements—wherein a metal layer or a metal/polymer dispersion layer is deposited in an electroless manner on the apparatus(es) or apparatus part(s) to be coated by bringing the parts into contact with a metal electrolyte solution which, in addition to the metal electrolyte, comprises a reducing agent and optionally the polymer or polymer mixture to be deposited in dispersed form, where at least one polymer is halogenated. This is optionally followed by conditioning. The invention furthermore relates to surfaces of apparatuses and apparatus parts for chemical plant construction which have been coated by the process according to the invention, and to the use of the coating comprising a metal component, at least one halogenated polymer and optionally further polymers for reducing the tendency of the coated surfaces to bind solids from fluids, with formation of deposits. Finally, the present invention relates to apparatuses and apparatus parts for chemical plant construction which have been coated by the process according to the invention.

Deposits in apparatuses and apparatus parts for the chemical plant construction represent a serious problem in the chemical industry. They particularly affect apparatus, tank and reactor walls, discharge devices, valves, pumps, filters, compressors, centrifuges, columns, dryers, comminution machines, internals, packing elements and mixing elements. These deposits are also known as fouling.

The coatings can have a variety of damaging or hindering effects for the process and may result in the necessity repeatedly to shut down and clean corresponding reactors or processing machines.

Measurement devices encrusted with coatings can result in incorrect and misleading results through which operating errors can occur.

A further problem arising through the formation of deposits is due to the fact that, in particular in coatings in polymerization reactors, the molecular parameters, such as molecular weight or degree of crosslinking, differ significantly from the product specification. If deposits detach during running operation, they may contaminate the product (for example specks in paints, inclusions in suspension beads). In the case of reactor walls, packing elements or mixing elements, undesired deposits can furthermore result in an undesired change in the residence-time profile of the apparatus or impair the effectiveness of the internals or mixing elements as such. Relatively large parts of coatings breaking off can result in blockage of discharge and processing devices, while small parts can result in impairment of the resultant product.

The deposits whose formation is to be prevented are coatings which can be caused, for example, by reaction with and on surfaces. Further reasons are adhesion to surfaces, which may be caused by van der Waals forces, polarization effects or electrostatic double layers. Other important effects are stagnation of movement at the surface and possibly reactions in said stagnating layers. Finally, mention should also be made of the following: precipitates from solutions, evaporation residues, cracking on locally hot surfaces and microbiological activities.

The causes are dependent on the respective material combinations and can be effective alone or in combination. While the processes resulting in the undesired coatings have been investigated quite well (for example A. P. Watkinson and D. I. Wilson, Experimental Thermal Fluid Sci. 1997, 14, 361 and literature cited therein), there are only few uniform concepts for preventing the above-described deposits. The processes disclosed hitherto have technical disadvantages.

Mechanical solutions have the disadvantage that they may cause considerable increased costs. Additional reactor internals may furthermore significantly change the flow profile of fluids in the reactors and consequently make expensive redevelopment of the process necessary. Chemical additives may result in undesired contamination of the product and in some cases pollute the environment.

For these reasons, there is an increasing search for ways of directly reducing the fouling tendency by modification of chemical reactors, reactor parts and processing machines for chemical products.

It is an object of the present invention to provide a process for the surface modification of apparatuses and apparatus parts for chemical plant construction

- which firstly reduces the tendency of the surfaces to bind solids with formation of deposits,
- where the surfaces treated by the process should have good durability,
- and where it should also be possible to use the process according to the invention in an inexpensive manner for surfaces which are not readily accessible, and secondly
- ensures that the product or products is (are) not contaminated by additives.

It is a further object of the present invention to provide protected surfaces of apparatuses and apparatus parts for chemical plant construction, and finally to use apparatuses and apparatus parts for chemical plant construction.

We have found that this object is achieved by a process for coating the surface of apparatuses and apparatus parts for chemical plant construction, wherein a metal layer or a metal/polymer dispersion layer is deposited in an electroless manner on the apparatus(es) or apparatus part(s) to be coated by bringing the parts into contact with a metal electrolyte solution which, in addition to the metal electrolyte, comprises a reducing agent and optionally the polymer or polymer mixture to be deposited in dispersed form, where at least one polymer is halogenated.

This solution according to the invention is based on a process for the electroless chemical deposition of metal/polymer dispersion layers which is known per se (W. Riedel: Funktionelle Vernickelung, Verlag Eugen Leize, Saulgau, 1989, pp. 231 to 236, ISBN 3-750480-044-x). The deposition of the metal layer or metal/polymer dispersion phases serves to coat the apparatuses and apparatus parts known per se in chemical plant construction. The metal layer according to the invention comprises an alloy or alloy-like mixed phase of a metal and at least one further element. The metal/polymer dispersion phases which are preferred in accordance with the invention comprise a polymer, for the purposes of the invention a halogenated polymer, which is dispersed in the metal layer. The metal alloy is preferably a metal/boron alloy or a metal/phosphorus alloy having a boron or phosphorus content respectively of from 0.5 to 15% by weight.

A particularly preferred embodiment of the coatings according to the invention involves so-called "chemical nickel systems", i.e. phosphorus-containing nickel alloys having a phosphorus content of from 0.5 to 15% by weight; very particular preference is given to phosphorus-containing nickel alloys having a phosphorus content of from 5 to 12% by weight.

The metal/polymer dispersion layer which is preferred in accordance with the invention and is also referred to as the composite layer comprises a metal component and at least one polymer, for the purposes of the present invention at least one halogenated polymer, and optionally further polymers which are dispersed in the metal component.

In contrast to electrodeposition, the electrons necessary for this purpose in chemical or autocatalytic deposition are not provided by an external current source, but instead are generated by chemical reaction in the electrolyte itself (oxidation of a reducing agent). The coating is carried out, for example, by dipping the workpiece into a metal electrolyte solution, which has optionally been mixed in advance with a stabilized polymer dispersion.

The metal electrolyte solutions used are usually commercially available or freshly prepared metal electrolyte solutions to which, in addition to the electrolyte, the following components have also been added: a reducing agent, such as an alkali metal hypophosphite or borohydride (for example NaBH4), a buffer mixture for setting the pH; optionally an activator, for example an alkali metal fluoride, preferably NaF, KF or LiF; carboxylic acids, and optionally a deposition moderator, for example $Pb^{2+}$. The reducing agent here is selected in such a way that the corresponding element to be incorporated is already present in the reducing agent.

The halogenated polymer optionally to be used in the process according to the invention is halogenated and preferably fluorinated. Examples of suitable fluorinated polymers are polytetrafluoroethylene, perfluoroalkoxy polymers (PFAs, for example containing $C_1$–$C_8$-alkoxy units), copolymers of tetrafluoroethylene and perfluoroalkyl vinyl ethers, for example perfluorovinyl propyl ether. Particular preference is given to polytetrafluoroethylene (PTFE) and perfluoroalkoxy polymers (PFAs, in accordance with DIN 7728, Part 1, Jan. 1988).

The use form employed is sensibly a commercially available polytetrafluoroethylene dispersion (PTFE dispersion). Preference is given to PTFE dispersions having a solids content of from 35 to 60% by weight and a mean particle diameter of from 0.05 to 1.2 $\mu$m, in particular from 0.1 to 0.3 $\mu$m. Particular preference is given to spherical particles since the use of spherical particles results in very homogeneous composite layers. An advantageous factor in the use of spherical particles is rapid layer growth and better, in particular longer thermal stability of the baths, which offers economic advantages. This is particularly evident in comparison with systems using irregular polymer particles obtained by grinding the corresponding polymer. In addition, the dispersions used may comprise a nonionic detergent (for example polyglycols, alkylphenol ethoxylate or optionally mixtures of said substances, from 80 to 120 g of neutral detergent per liter) or an ionic detergent (for example alkyl and haloalkyl sulfonates, alkylbenzenesulfonates, alkylphenol ether sulfates, tetraalkylammonium salts or optionally mixtures of said substances, from 15 to 60 g of ionic detergent per liter) for stabilization of the dispersion. It is also possible additionally to add fluorinated surfactants (neutral and ionic), typically 1–10% by weight, based on the total amount of surfactant, being used.

The coating is carried out at slightly elevated temperature, but this must not be so high that destabilization of the dispersion occurs. Temperatures of from 40 to 95° C. have proven suitable. Preference is given to temperatures of from 80 to 91° C. but particularly preferably 88° C.

Deposition rates of from 1 to 15 $\mu$m/h have proven useful. The deposition rate can be affected as follows by the composition of the dip baths:

- Higher temperatures increase the deposition rate, there being a maximum temperature which is limited, for example, by the stability of the polymer dispersion optionally added. Lower temperatures reduce the deposition rate.
- Higher electrolyte concentrations increase and lower ones decrease the deposition rate; concentrations of from 1 g/l to 20 g/l of $Ni^{2+}$ being appropriate, and concentrations of from 4 g/l to 10 g/l being preferred; for $Cu^{2+}$, from 1 g/l to 50 g/l are appropriate.
- Higher concentrations of reducing agent likewise enable the deposition rate to be increased;
- An increase in the pH allows the deposition rate to be increased. A pH of between 3 and 6, particularly preferably of between 4 and 5.5, is preferably set.
- Addition of activators, for example alkali metal fluorides, for example NaF or KF, increases the deposition rate.

Particular preference is given to commercially available nickel electrolyte solutions which comprise $Ni^{2+}$, sodium hypophosphite, carboxylic acids and fluoride and optionally deposition moderators, such as $Pb^{2+}$. Such solutions are marketed, for example, by Riedel Galvano- und Filtertechnik GmbH, Halle, Westphalia, and Atotech Deutschland GmbH, Berlin. Particular preference is given to solutions which have a pH of about 5 and comprise about 27 g/l of $NiSO_4 \cdot 6\ H_2O$ and about 21 g/l of $NaH_2PO_2 \cdot H_2O$ with a PTFE content of from 1 to 25 g/l.

The polymer content of the dispersion coating is affected principally by the amount of added polymer dispersion and the choice of detergents. The concentration of the polymer plays a greater role here; high polymer concentrations in the dip baths result in a disproportionately high polymer content in the metal/phosphorus/polymer dispersion layer or metal/boron/polymer dispersion layer.

For the contacting, the parts to be coated are dipped into dip baths containing the metal electrolyte solution. Another embodiment of the process according to the invention comprises filling the tanks to be coated with metal electrolyte solution. A further suitable process comprises pumping the electrolyte solution through the part to be coated; this variant is particularly recommended if the diameter of the part to be coated is much smaller than the length.

The dipping operation is preferably followed by conditioning at temperatures of from 200 to 400° C., especially at from 315 to 380° C. The conditioning duration is generally from 5 minutes to 3 hours, preferably from 35 to 60 minutes.

It has been found that the surfaces treated in accordance with the invention enable good transmission of heat although the coatings may have a not inconsiderable thickness of from 1 to 100 $\mu$m, preferably from 3 to 50 $\mu$m, in particular from 5 to 25 $\mu$m. The polymer content of the dispersion coating is from 5 to 30% by volume, preferably from 15 to 25% by volume. The surfaces treated in accordance with the invention furthermore have excellent durability.

In a further embodiment, the metal/polymer dispersion layer comprises an additional polymer in order further to strengthen the anti-adhesive properties of the coating. This polymer may be halogenated or non-halogenated. Particular preference is given to the use of polytetrafluoroethylene or ethylene polymers and ethylene copolymers or polypropylenes, very particular preference being given to ultrahigh-molecular-weight polyethylene (UHM-PE). For the purposes of the present invention, the term UHM-PE is taken to mean a polyethylene which has a molar mass $M_w$ of $10^6$ g or more and a Staudinger index of at least 15 dl/g, preferably at least 20 dl/g.

This optionally used polymer is likewise added as dispersion or suspension to an aqueous surfactant solution, the sequence of addition of the dispersions being unimportant. However, preference is given to simultaneous metering of the two polymer dispersions. Aqueous dispersions of UHM-PE are commercially available, for example from Clariant GmbH, or can easily be prepared by dispersion of the UHM-PE in a suitable aqueous surfactant solution. Neutral detergents (for example polyglycols, alkylphenol ethoxylate or optionally mixtures thereof, from 80 to 120 g of neutral detergent per liter), ionic detergents (for example alkyl- and haloalkylsulfonates, alkylbenzenesulfonates, alkylphenol ether sulfates, tetraalkylammonium salts or optionally mixtures of said substances, from 15 to 60 g of ionic detergent per liter) are suitably present. It is additionally possible to add fluorinated surfactants (neutral or ionic), typically 1–10% by weight, based on the total amount of surfactant, being used.

It is important that the particles of the further halogenated or non-halogenated polymer are larger than those of the halogenated polymer. Thus, mean particle diameters of from 5 to 50 $\mu$m have proven advantageous. 25–35 $\mu$m are particularly advantageous. It is possible for the additional larger polymer used to comprise spherical particles, but the particles of the additional polymer may also have an irregular shape.

It is important that the particle diameter distribution of the various polymers can be regarded as bimodal in overall terms.

From 1 to 20 g, preferably from 5 to 10 g, of the larger polymer are added per liter of the dip-bath solution.

The present invention furthermore relates to a process for the production of modified, i.e. coated, surfaces of apparatuses and apparatus parts for chemical plant construction which are particularly anti-adhesive, durable and heat-resistant and therefore achieve the object according to the invention in a particular manner.

In this process, a metal/phosphorus layer with a thickness of from 1 to 15 $\mu$m, preferably from 1 to 5 $\mu$m, is additionally applied by electroless chemical deposition before application of the metal/polymer dispersion layer.

The electroless chemical application of a metal/phosphorus layer with a thickness of from 1 to 15 $\mu$m in order to improve adhesion is in turn carried out by means of metal electrolyte baths to which in this case, however, no stabilized polymer dispersion is added. The conditioning is preferably omitted at this point in time, since this generally has an adverse effect on the adhesion of the subsequent metal/polymer dispersion layer. After deposition of the metal/phosphorus layer, the workpiece is introduced into a second dip bath which, in addition to the metal electrolyte, also comprises a stabilized polymer dispersion. The metal/polymer dispersion layer forms here.

Additionally in this process, a metal/phosphorus layer with a thickness of from 1 to 15 $\mu$m, preferably from 1 to 5 $\mu$m, is additionally applied by electroless chemical deposition before application of the metal/polymer dispersion layer.

The electroless chemical application of a metal/phosphorus layer with a thickness of from 1 to 15 $\mu$m in order to improve adhesion is carried out by means of the metal electrolyte baths described above to which in this case, however, no stabilized polymer dispersion is added. The conditioning is preferably omitted at this point in time, since this generally has an adverse effect on the adhesion of the subsequent metal/polymer dispersion layer. After deposition of the metal/phosphorus layer, the workpiece is introduced into the above-described dip bath which, in addition to the metal electrolyte, also comprises a stabilized polymer dispersion. The metal/polymer dispersion layer forms here.

If the embodiment which provides the additional use of a non-halogenated polymer is selected, conditioning of the finished coating is preferably omitted.

In a preferred embodiment of the process according to the invention, the additional metal/phosphorus layer is a nickel/phosphorus or copper/phosphorus layer, nickel/phosphorus being particularly preferred.

Owing to its simple handling, the process according to the invention can be used for all surfaces of apparatuses and apparatus parts for chemical plant construction which are threatened by deposits, the surfaces preferably being surfaces of metal, particularly preferably of steel.

Tank and apparatus walls may be present in various tanks, apparatuses or reactors used for chemical reactions.

Tanks are, for example, stock or collecting tanks, for example troughs, silos, drums or gas tanks.

Apparatuses and reactors are liquid, gas/liquid, liquid/liquid, solid/liquid, gas/solid or gas reactors implemented, for example, in the following ways:
stirred-tank, jet loop and jet reactors,
jet pumps,
residence-time cells,
static mixers,
stirred columns,
tubular reactors,
cylindrical stirrers,
bubble columns,
jet and venturi scrubbers,
fixed-bed reactors,
reaction columns,
evaporators,
rotating-disk reactors,
extraction columns,
compounding and mixing reactors and extruders,
mills,
belt reactors,
rotary tubes or
circulating fluidized beds;

Discharge devices are, for example, discharge ports, discharge funnels, discharge pipes, valves, discharge stop cocks or ejection devices.

Valves are, for example, stop cocks, slides, burst disks, non-return valves or disks.

Pumps are, for example, centrifugal pumps, gear pumps, screw displacement pumps, eccentric single-rotor screw pumps, annular rotating piston pumps, reciprocating piston pumps, membrane pumps, screw trough pumps or liquid jet pumps, in addition reciprocating piston vacuum pumps, reciprocating piston membrane vacuum pumps, rotating piston vacuum pumps, rotating plunger vacuum pumps, liquid-ring vacuum pumps, Roots vacuum pumps or fluid entrainment pumps.

Filter apparatuses are, for example, fluid filters, fixed-bed filters, gas filters, sieves or separators.

Compressors are, for example, piston compressors, piston membrane compressors, positive displacement rotary compressors, rotary multi-vane compressors, liquid piston compressors, rotary compressors, Roots compressors, screw compressors, jet compressors or turbo compressors.

Centrifuges are screen-type centrifuges or solid-wall centrifuges, preference being given to disk centrifuges, solid-wall screw centrifuges (decanters), screen-conveyor centrifuges and reciprocating-pusher centrifuges.

Columns are tanks with exchange plates, preference being given to bubble-cap, valve plates or sieve plates. In addition, the columns may be filled with various packing elements, for example saddle packings, Raschig rings or beads.

Comminution machines are, for example, crushers, preference being given to hammer crushers, impact crushers, roller crushers or jaw crushers;

or mills, preference being given to hammer mills, cage mills, pin mills, impact mills, tubular mills, drum mills, ball mills, vibratory mills and roller mills.

Internals in reactors and tanks are, for example, thermal sleeves, baffles, foam breakers, packing elements, spacers, centering devices, flange connections, static mixers, instruments serving for analysis, such as pH or IR probes, conductivity measurement instruments, level measurement instruments or foam probes.

Extruder elements are, for example, screw shafts and elements, extruder barrels, plastication screws or injection nozzles.

The invention furthermore relates to apparatuses and apparatus parts for chemical plant construction which are obtainable by the surface-modification process according to the invention. The surfaces according to the invention are preferably produced by using the process according to the invention.

The invention furthermore relates to the use of the surface modification according to the invention for reducing the tendency of the coated surfaces to bind solids with formation of deposits. The deposits whose formation is to be prevented according to the invention have already been described above.

The invention furthermore relates to coated apparatuses and apparatus parts for chemical plant construction. The reactors, reactor parts and chemical-product processing machines according to the invention are distinguished by a longer service life, reduced downtimes and reduced cleaning costs.

The reactors according to the invention can be used for numerous different types of reaction, for example polymerizations, syntheses of bulk or fine chemicals or pharmaceutical products and their precursors, and cracking reactions. The processes are continuous, semi-continuous or batchwise, the apparatuses and apparatus parts according to the invention being particularly suitable for use in continuous processes.

The invention will be explained below with reference to a working example.

Working example:

In attempts to optimize the Styropor® production process (in accordance with EP-A 0 575 872) on a laboratory scale (41 stirred-tank reactor), uncoated V2A steels and steels with a surface modified in accordance with the invention were used in parallel.

The following procedure was used for the coating:

1. Coating With Nickel/PTFE

The coating was carried out in two steps. Firstly, a number of parts were removed from the autoclave: stirrers, thermal sleeves, baffles, lids and parts of the inside of the reactor. These parts were immersed at a temperature of 88° C. in a trough containing 2 liters of an aqueous nickel-salt solution, the solution having the following composition: 27 g/l of $NiSO_4 \cdot 6\ H_2O$, 21 g/l of $NaH_2PO_2 \cdot 2H_2O$, 20 g/l of lactic acid $CH_3CHOHCO_2H$, 3 g/l of propionic acid $C_2H_5CO_2H$, 5 g/l of sodium citrate, 1 g/l of NaF. The pH was 4.8. 45 minutes were needed to obtain the desired layer thickness of 9 $\mu$m.

No rinsing was carried out after this step.

The reactor parts were subsequently dipped into a second trough to which, in addition to 2 liters of an analogous nickel-salt solution, 20 ml, i.e. 1% by volume, of a PTFE dispersion having a density of 1.5 g/ml had additionally been added. This PTFE dispersion had a solids content of 50% by weight. At a deposition rate of 10 $\mu$m/h, the process was complete in 90 minutes (layer thickness 15 $\mu$m). The coated reactor parts were rinsed with water, dried and conditioned at 350° C. for one hour.

2. Coating With Nickel/PTFE/UHM-PE

The coating was carried out in two steps. Firstly, a number of parts were removed from the autoclave: stirrers, thermal sleeves, baffles, lids and parts of the inside of the reactor. These parts were immersed at a temperature of 88° C. in a trough containing 2 liters of an aqueous nickel-salt solution, the solution having the following composition: 27 g/l of $NiSO_4 \cdot 6\ H_2O$, 21 g/l of $NaH_2PO_2 \cdot 2H_2O$, 20 g/l of lactic acid $CH_3CHOHCO_2H$, 3 g/l of propionic acid $C_2H_5CO_2H$, 5 g/l of sodium citrate, 1 g/l of NaF. The pH was 4.8. 45 minutes were needed to obtain the desired layer thickness of 9 $\mu$m.

No rinsing was carried out after this step.

The reactor parts were subsequently dipped into a second trough to which, in addition to 2 liters of an analogous nickel-salt solution, 20 ml, i.e. 1% by volume, of a PTFE dispersion having a density of 1.5 /ml had additionally been added; furthermore, 7 g/l of UHM-PE (Clariant AG) were added. This PTFE/UHM-PE dispersion had a solids content of 50% by weight. At a deposition rate of 10 $\mu$m/h, the process was complete in 90 minutes (layer thickness 15 $\mu$m). The coated reactor parts were rinsed with water and dried at room temperature. The conditioning was omitted.

The reactor parts were installed in a test autoclave for the production of Styropor. The stirred-tank reactor thus contained both coated and uncoated parts which it was possible to test in polymerization experiments under identical conditions. The polymerization was carried out as follows by a process in accordance with the process described in EP-B 0 575 872 (p. 5, lines 8 ff.):

2.61 g of $Na_4P_2O_7$ were dissolved in 89.7 ml of water at room temperature. A solution of 4.89 g of $MgSO_4 \cdot 7H_2O$ in 44.8 ml of water was added to this solution with stirring, and the mixture was stirred for a further 5 minutes.

1.4 1 of water were introduced into the stirred-tank reactor containing the coated internals described above, and the $Na_4P_2O_7/MgSO_4$ solution was added with stirring. 1 523 ml of styrene (freshly distilled) together with 4.23 g of dicumyl peroxide and 2.26 g of dibenzoyl peroxide were subsequently added. Furthermore, 0.55 g of $\alpha$-methylstyrene and 1.7 g of Luwax® were dissolved in the organic phase with stirring. The mixture was saturated with nitrogen and heated to 90° C. over the course of 2 hours. 2 hours after the 80° C. threshold had been exceeded, 0.23 g of a 40% strength by weight solution of Mersolat® K30 together with 0.18 g of a 20% strength by weight aqueous sodium hydroxide solution and 0.12 g of acrylic acid (100%) were added, and after a further 50 minutes, 123.5 g of n-heptane were added. During this, the temperature was kept constant at 90° C., and the suspension was polymerized to completion.

After a total of 20 hours, the reaction was terminated, the reaction mixture was cooled to room temperature over the course of 1 hour, and the stirred-tank reactor was emptied.

Inspection of the stirred-tank reactor showed that significantly less polymer coating was evident on all points coated with the coating according to the invention than at uncoated points. The polymer coatings on points coated with a coating according to the invention were easier to remove than the coatings on uncoated points. The evaluation is shown in Table 1.

In some cases, it was possible for the coating at points coated with a coating according to the invention to be rubbed off manually. If the coating at points coated with a coating according to the invention had to be removed by dissolution in toluene or another suitable solvent, the dissolution times were significantly shorter than in the case of coatings at uncoated points.

For evaluation, the coatings on baffles and on stirrers were weighed.

1 baffle was uncoated,
empty weight: 61.51 g uncoated
1 baffle was coated with Ni/PTFE by the process according to the invention
empty weight: 60.78 g coated,
1 baffle was coated with Ni/PTFE/UHM-PE by the process according to the invention
empty weight: 62.04 g coated The polymerization examples were repeated, in each case
1 experiment with an uncoated stirrer and
1 experiment with a stirrer coated with a coating according to the invention
empty weight: 490.52 g uncoated
empty weight: 493.28 g coated The stirrer speeds are shown in Table 1.

TABLE 1

| Experiment | Stirrer speed rpm | Deposit on points without coating [g] | | | | | | Deposit on points with an NiP-PTFE-coating [g] | | | |
|---|---|---|---|---|---|---|---|---|---|---|---|
| | | Stirrer | | Baffle | | | | stirrer | Baffle without PE | | Baffle with PE |
| 1 | 300 | n.m. | | 4.21 | | | | | 0.43 | | |
| 2 | 350 | n.m. | | 5.01 | | | | | 0.87 | | |
| 3a/3b | 375 | 4.20 | — | 3.38 | 2.89 | — | 1.02 | | 0.48 | 0.53 | 0.21 |
| 4a/4b | 275 | 7.26 | — | 6.31 | 5.22 | — | 1.87 | | 0.98 | 0.68 | 0.59 |
| 5 | 300 | n.m. | | 2.14 | | | | | 0.20 | | |
| 6a/6b | 325 | 4.87 | — | 3.20 | 4.25 | — | 1.72 | | 0.51 | 0.57 | 0.32 |

n.m.: not measured n.m.: not measured

In basic experiments on process optimization of Terluran production on a laboratory scale (4 1 autoclave), steels having a surface modified by a coating according to the invention were likewise used in parallel to V2A steels.

The polymerization examples were carried out in accordance with DE-A 197 28 629 and EP-A 0 062 901, in each case Example 1, but the mixing ratios were adapted to the 2-liter autoclave and the stirrer speed was varied as shown in Table 2.

Starting from a total of 661.61 g of butadiene, the polymerization was carried out at 67° C. in the presence of 6.59 g of tert-dodecyl mercaptan ("TMD"), 4.6 g of potassium stearate, 1.23 g of potassium persulfate, 1.99 g of sodium hydrogencarbonate and 824 g of water. The reactor was subsequently emptied and inspected.

The stirrer was coated. It was again observed that deposits occurred to a significantly reduced extent at the points coated by the process according to the invention and could be removed more simply than at uncoated points.

Deposits on the stirrers were weighed.
3 experiments were reproduced, in each case
1 experiment with an uncoated stirrer and
1 experiment with a stirrer coated with Ni/P/PTFE
Empty weight: 376.53 g uncoated
Empty weight: 378.49 g coated
with otherwise identical reaction and process conditions.

TABLE 2

| Experiment | Stirrer speed rpm | Deposit on points without coating [g] | Deposit on points with a coating according to the invention [g] |
|---|---|---|---|
| | | Stirrer | Stirrer |
| 1 | 400 | 4.89 | 1.21 |
| 2 | 350 | 5.72 | 1.33 |
| 3 | 300 | 3.51 | 0.89 |

We claim:

1. A process for coating apparatuses and apparatus parts for chemical plant construction, which comprises a metal layer and thereafter a metal/polymer dispersion layer being deposited in an electroless manner on the apparatus(es) or apparatus part(s) to be coated by firstly depositing a metal/phosphorus layer having a thickness of from 1 to 15 $\mu$m in an electroless manner on the apparatus(es) or apparatus parts and then bringing the apparatus(es) or apparatus part(s) into contact with a metal electrolyte solution which, in addition to the metal electrolyte, comprises a reducing agent and the polymer or polymer mixture to be deposited in dispersed form, wherein at least one polymer is halogenated and comprises spherical particles having a mean diameter of from 0.1 to 1.0 $\mu$m.

2. A process as claimed in claim 1, wherein the apparatuses and apparatus parts for chemical plant construction are selected from the group consisting of apparatus(es), tank and reactor internal walls, discharge devices, valves, line systems, pumps, filters, compressors, centrifuges, columns, dryers, comminution machines, internals, packing elements and mixing elements which consist of a metallic material.

3. A process as claimed in claim 1, wherein the metal electrolyte used is a nickel or copper electrolyte solution, and the reducing agent used is a hypophosphite or a borohydride.

4. A process as claimed in claim 1, wherein a dispersion of a halogenated polymer is added to the metal electrolyte solution.

5. A process as claimed in claims 1, wherein the metal electrolyte employed is a nickel salt solution, which is reduced in situ using an alkali metal hypophosphite and to which a polytetrafluoroethylene dispersion is added as halogenated polymer.

6. A process as claimed in claim 1, wherein a nickel/phosphorus/polytetrafluoroethylene layer having a thickness of from 1 to 100 $\mu$m is deposited.

7. A process as claimed in claim 1, wherein a nickel/phosphorus/polytetrafluoroethylene layer having a thickness of from 3 to 50 $\mu$m is deposited.

8. A process as claimed in claim 1, wherein a nickel/phosphorus/polytetrafluoroethylene layer having a thickness of from 5 to 25 $\mu$m is deposited.

9. A process as claimed in claim 1, wherein a further dispersion of a halogenated or non-halogenated polymer is added to the metal electrolyte solution.

10. A process as claimed in claim 9, wherein the additional polymer used is a polytetrafluoroethylene or polyethylene or polypropylene.

11. A process as claimed in claim 9, wherein the additional polymer used is a polytetrafluoroethylene or polyethylene or polypropylene comprising particles having a mean diameter of from 5 to 50 $\mu$m.

12. An apparatus or apparatus part for chemical plant construction, obtainable by a process as claimed in claim 1.

13. An apparatus, tank or reactor wall, discharge device, valve, line system, pump, filter, compressor, centrifuge, column, dryer, comminution machine, internal, packing element or mixing element obtainable by a process as claimed in claim 1.

14. A process for preventing or reducing deposits from fluids on an apparatus, tank or reactor wall, discharge device, valve, line system, pump, filter, compressor, centrifuge, column, dryer, comminution machine, internal, packing element or mixing element, comprising coating the appropriate item according to the process claimed in claim 1.

* * * * *